US012673839B2

(12) United States Patent
Cardoso et al.

(10) Patent No.: US 12,673,839 B2
(45) Date of Patent: Jul. 7, 2026

(54) ADJUSTABLE CONVEYOR SYSTEM FOR A CONVERTING MACHINE

(71) Applicant: BOBST MEX SA, Mex (CH)

(72) Inventors: Bryan Cardoso, Cugy (CH); Jeremy Lauth, Echallens (CH)

(73) Assignee: BOBST MEX SA, Mex (CH)

( * ) Notice: Subject to any disclaimer, the term of this patent is extended or adjusted under 35 U.S.C. 154(b) by 84 days.

(21) Appl. No.: 18/719,330

(22) PCT Filed: Dec. 20, 2022

(86) PCT No.: PCT/EP2022/086930

§ 371 (c)(1),
(2) Date: Jun. 13, 2024

(87) PCT Pub. No.: WO2023/118099

PCT Pub. Date: Jun. 29, 2023

(65) Prior Publication Data

US 2025/0042685 A1 Feb. 6, 2025

(30) Foreign Application Priority Data

Dec. 22, 2021 (EP) ..... 21217128

(51) Int. Cl.
*B65H 29/16* (2006.01)
*B65H 29/12* (2006.01)
*B65H 33/12* (2006.01)

(52) U.S. Cl.
CPC ..... *B65H 29/16* (2013.01); *B65H 29/12* (2013.01); *B65H 33/12* (2013.01);
(Continued)

(58) Field of Classification Search
None
See application file for complete search history.

(56) References Cited

U.S. PATENT DOCUMENTS 3,294,216 A * 12/1966 Lawrence ..... B65G 21/14 198/812
4,260,053 A * 4/1981 Onodera ..... B65G 17/064 198/849

(Continued)

FOREIGN PATENT DOCUMENTS

CN 105980278 A 9/2016
CN 110525863 A * 12/2019 ..... B65G 41/003

(Continued)

*Primary Examiner* — Gene O Crawford
*Assistant Examiner* — Muhammad Awais
(74) *Attorney, Agent, or Firm* — Bookoff McAndrews, PLLC

(57) ABSTRACT

The present invention relates to a conveyor system (30) for transporting blanks (2') in a converting machine (1). The conveyor system comprises an endless first conveyor belt (32*a*) and a support structure (38). The support structure (38) comprising a plurality of rollers (56), each roller being attached to a roller frame (54) and arranged in a line, the roller frames being connected to each other by a connection mechanism (62). The connection mechanism (62) is extendable and retractable in the direction of transportation, such that a contact length (Lc) of the first conveyor belt is modified and all rollers remain in contact with the first conveyor belt.

14 Claims, 12 Drawing Sheets

(52) U.S. Cl.
CPC .... *B65H 2402/30* (2013.01); *B65H 2404/254* (2013.01); *B65H 2701/1766* (2013.01)

(56) References Cited

U.S. PATENT DOCUMENTS

| | | | | | |
|---|---|---|---|---|---|
| 4,860,878 | A * | 8/1989 | Mraz | B65G 21/14 | 198/594 |
| 5,046,603 | A * | 9/1991 | Odenthal | B65H 29/36 | 198/588 |
| 5,181,600 | A * | 1/1993 | Chappell | B65G 21/14 | 198/309 |
| 5,456,348 | A * | 10/1995 | Whetsel | B65G 13/07 | 198/782 |
| 5,718,325 | A * | 2/1998 | Doster | B65G 43/08 | 414/508 |
| 6,003,658 | A * | 12/1999 | Best | B65G 41/008 | 198/588 |
| 6,935,487 | B2 | 8/2005 | Schaum et al. | | |
| 9,004,264 | B2 * | 4/2015 | Baek, IV | B65G 21/14 | 198/588 |
| 2004/0094391 | A1 * | 5/2004 | Schaum | B65G 21/14 | 198/812 |
| 2005/0279616 | A1 * | 12/2005 | Pogue | B65G 21/14 | 198/861.1 |
| 2008/0060916 | A1 * | 3/2008 | Whittlesey | B65G 21/06 | 198/812 |
| 2010/0018835 | A1 * | 1/2010 | Kinnunen | B65G 21/14 | 198/313 |
| 2011/0056797 | A1 * | 3/2011 | Tsai | B65H 31/3009 | 198/374 |
| 2020/0385214 | A1 * | 12/2020 | Karol | B65G 13/12 | |

FOREIGN PATENT DOCUMENTS

| | | | | | |
|---|---|---|---|---|---|
| CN | 111086847 | A | | 5/2020 | |
| CN | 211077480 | U | | 7/2020 | |
| CN | 112124845 | A | * | 12/2020 | B65G 13/12 |
| CN | 212739488 | U | | 3/2021 | |
| CN | 213111112 | U | | 5/2021 | |
| CN | 113023225 | A | * | 6/2021 | B65G 13/07 |
| CN | 113666048 | A | * | 11/2021 | B65G 13/00 |
| CN | 113734689 | A | * | 12/2021 | B65G 13/07 |
| DE | 102011012807 | A1 | | 3/2012 | |
| EP | 1588966 | A1 | | 10/2005 | |
| GB | 2477568 | A | * | 8/2011 | B65G 41/00 |
| JP | H1034628 | A | * | 2/1998 | |
| JP | 2014152017 | A | * | 8/2014 | |
| KR | 20200132282 | A | * | 11/2020 | B65B 35/44 |
| KR | 1020200132282 | A | | 11/2020 | |
| KR | 102279891 | B1 | * | 7/2021 | B65G 13/02 |
| WO | 2022028894 | A1 | | 2/2022 | |

* cited by examiner

ADJUSTABLE CONVEYOR SYSTEM FOR A CONVERTING MACHINE

CROSS-REFERENCE TO RELATED APPLICATION(S)

This application is a National Stage Application under 35 U.S.C. § 371 of International Application No. PCT/EP2022/086930, filed on Dec. 20, 2022, which claims priority to European Application No. 21217128.4, filed on Dec. 22, 2021, the entireties of which are incorporated herein by reference.--

FIELD OF THE INVENTION

The present invention relates to a conveyor system with an adjustable length for a converting machine.

BACKGROUND

Converting machines are used in the production of paperboard and cardboard boxes, such as folding boxes. These machines comprise a plurality of workstations which may print, cut, crease, fold, count and stack blanks. The blank is initially placed in a feeder module and is conveyed through the different workstations.

The converting machines need to be adapted to different format of boxes, and this often leads to adjusting the position of a conveyor belt system, or changing transportation lengths of conveyor belt systems.

Document WO22028894 discloses a transfer module for a folder gluer machine. The transfer module comprises a conveyor belt with a displaceable outlet end. The conveyor belt is provided a variable contact length, over which the conveyor belt is in contact with the blanks. The contact length of the conveyor belt is held into shape of by a support structure including a plurality of rollers attached to each other in a chain. When the position of the displaceable outlet end is changed, some rollers enter into a storage area in the transfer module.

SUMMARY

In view of the prior art, there is a need to provide a compact and reliable conveyor adjustment mechanism which can be easily integrated into different workstations. This object is solved by a conveyor system according to claim 1.

According to a first aspect of the present invention, there is provided a conveyor system for transporting blanks in a converting machine, the conveyor system comprising an endless first conveyor belt and a support structure, wherein the first conveyor belt is configured to convey the blanks along a direction of transportation, the first conveyor belt having a contact length supported by the support structure and a return length.

The support structure comprises a plurality of rollers, each roller being attached to a roller frame and arranged in a line, the roller frames being connected to each other by a connection mechanism.

A plurality of the roller frames is movable in the direction of transportation, and wherein a displacement mechanism is configured to displace a distal movable roller frame at a displacement distance in the direction of transportation.

The connection mechanism is extendable and retractable in the direction of transportation, such that the contact length of the first conveyor belt is modified and all rollers remain in contact with the first conveyor belt.

A "plurality of roller frames" can be defined as at least some of a plurality of successive and adjacent roller frames.

Preferably, the blanks are only in contact with the first conveyor belt along the contact length.

In an embodiment, at least one distal roller frame is stationary.

The roller frame can also be referred to as a "roller carriage" or "roller block". With all rollers we mean all the rollers in the line from the distal fixed roller to the distal movable roller. Hence, all rollers remain in contact with the first conveyor belt independently of the change in contact length.

In an embodiment, a plurality of roller frames is slidably mounted to a linear guide rail. The guide rail is connected to a fixed frame portion, connected to a chassis of a work module.

Each roller may be mounted on a separate roller frame. Alternatively, a plurality of rollers is provided on each roller frame.

In an embodiment, the connection mechanism is configured to impart an equidistant displacement distance between the rollers. The equidistant displacement is an equal distribution of the change in contact length.

In an embodiment, the connection mechanism comprises a plurality of pivotable connection links. The pivotable connection links may comprise a first linear connection element and a second linear connection element, and wherein the linear connection elements form a cross, the first and second linear connection elements having their central pivot point and connection to each roller frame in the center of the cross.

The linear elements may be further connected in an upper pivot point and a lower pivot point, and wherein the upper and lower pivot points are horizontally immobile but vertically mobile in response to a displacement distance from the displacement mechanism, and wherein the central pivot point is horizontally movable in the direction of transportation but vertically immobile.

The first and second linear connection elements may each have a first convex shape and a second convex shape, and wherein the central pivot point is located between the first and second convex shapes. The first and second convex shapes may be hollow in the center.

In an embodiment, the conveyor system further comprising a movable compensation roller configured to change the return length of the conveyor belt.

In an embodiment, the conveyor system further comprises a second conveyor belt arranged after the first conveyor belt in the direction of transportation, and wherein the second conveyor belt is supported by a second support structure, and wherein the displacement mechanism is configured to increase the contact length of one conveyor belt, while reducing the contact length of the other conveyor belt with the same amount.

The displacement mechanism may further comprise a connection frame connected to the distal movable roller frames of the support structures of the first conveyor belt and the second conveyor belt, respectively. The connection frame is configured to perform a reciprocating movement in the direction of transportation.

In an embodiment, the connection frame is further attached to a compensation roller of the first conveyor belt and a compensation roller of the second conveyor bel, whereby a displacement of the connection frame both modifies the contact lengths and the return lengths of the first and second conveyor belts.

The displacement mechanism may comprise a motor and a displacement conveyor, and wherein the displacement conveyor is attached to the connection frame.

Alternatively, the displacement mechanism comprises a linearly movable piston actuator connected to the connection frame.

BRIEF DESCRIPTION OF THE DRAWINGS

The invention will now be described with reference to the appended drawings, in which like features are denoted with the same reference numbers and in which.

DETAILED DESCRIPTION

Figure 1A:
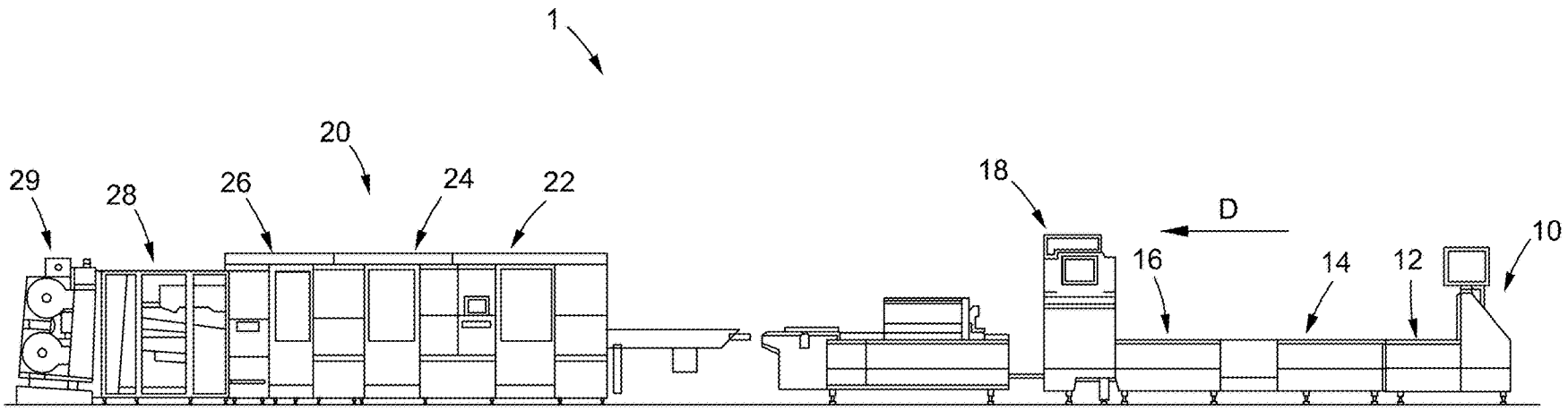
FIG. 1*a* is a schematic diagram of a folder gluer converting machine.
Figure 1C:
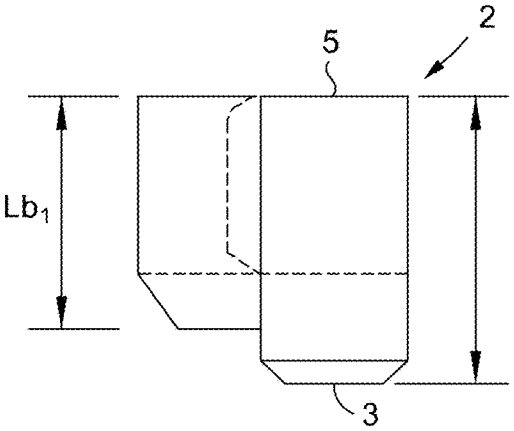
FIG. 1*c* is a top view of a folding box produced in the converting machine of FIG. 1*a;*
Figure 1B:
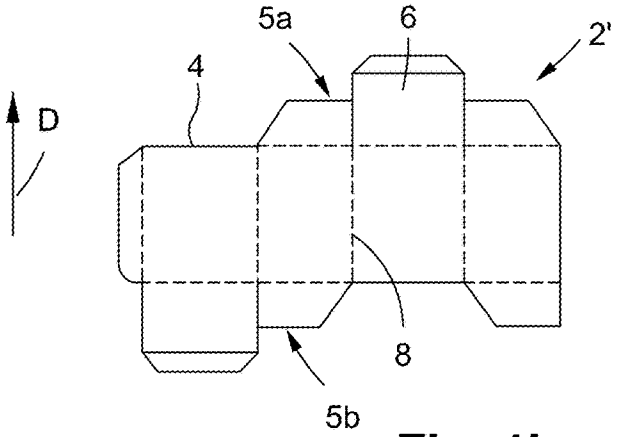
FIG. 1*b* is a top view of a blank to be placed in a feeder of the converting machine in FIG. 1*a,*

Referring to the figures and in particular to FIGS. 1*a* and 1*b* which illustrate a converting machine in the form of a folder gluer machine 1 and a blank 2' to be processed therein. The folder gluer machine 1 is configured to receive blanks 2' that are provided with a peripheral edge 4 defining the shape of flaps 6 and is further provided with crease-lines 8, which enable the folding of the blank 2' along pre-defined lines. At the end of the converting machine 1, the blanks 2' have been transformed into of folding boxes 2.

The present folder gluer machine 1 comprises a series of different workstations in the form of modules. The modules include, from an inlet to an outlet: a feeder module 10, a fold pre-breaking module 12, a gluing module 14 and a folding module 16. After the folding and gluing modules, a conditioning section 20 can be provided in order to count and separate a shingled stream of folding boxes 2 into separate batches and to arrange them together in banded stacks. The conditioning section 20 of the folder gluer 1 may comprise a counter and separator module 22, optionally a shingle inverter 24, a transfer module 26 arranged after the shingle inverter 24, a stacker module 28 configured to arrange the folding boxes 2 in stacks, and a banding module 29.

Several types of modules sometimes need to have their conveyance adapted to the format of the boxes 2 to be produced. Such examples include for example a transfer module 26 as illustrated in FIG. 2, a counter-separator module 22 as illustrated in FIG. 3 and an alignment module as described in document EP1588966A1.

Figure 2:
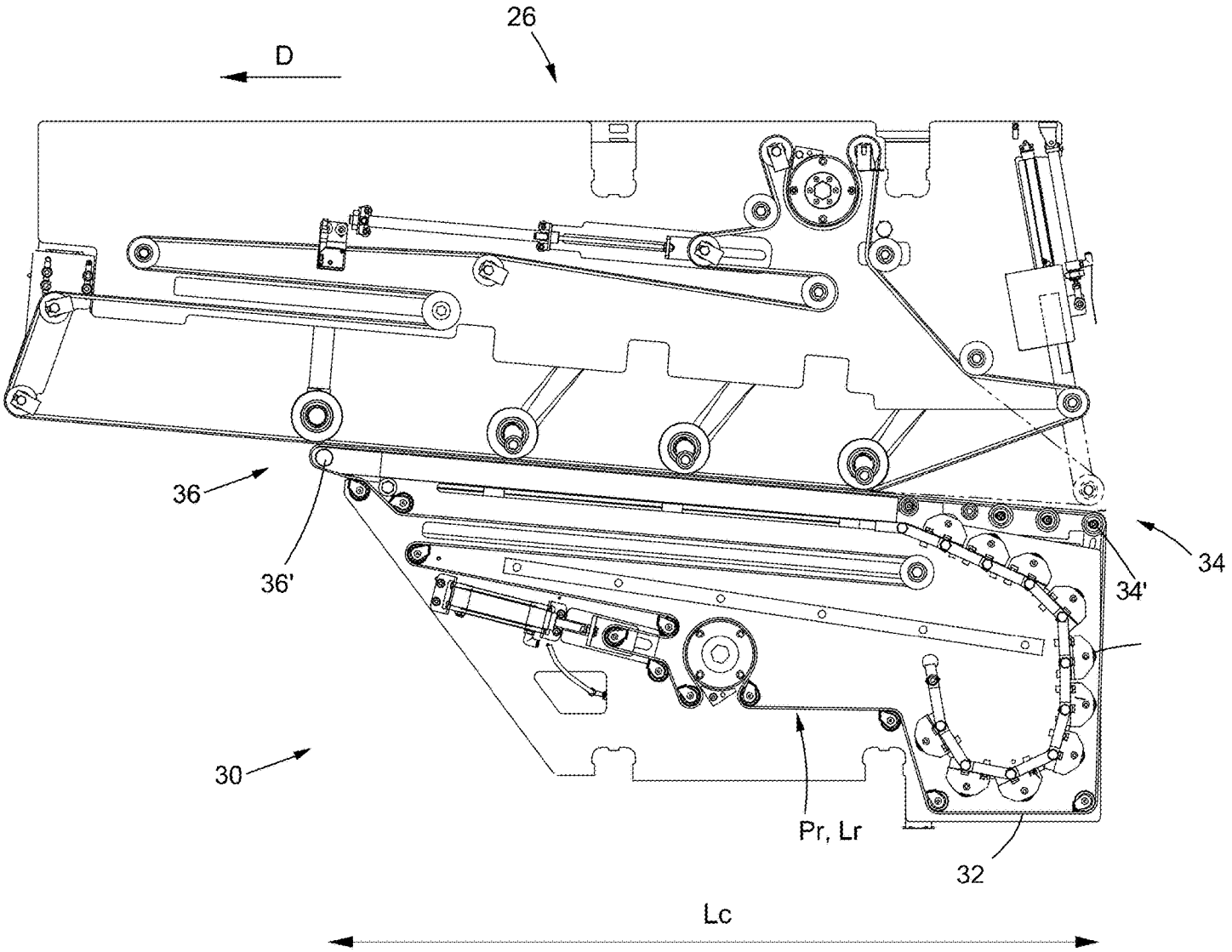
FIG. 2 is a schematic cross-sectional view of a transfer module of a converting machine as known in the prior art.
Figure 3:
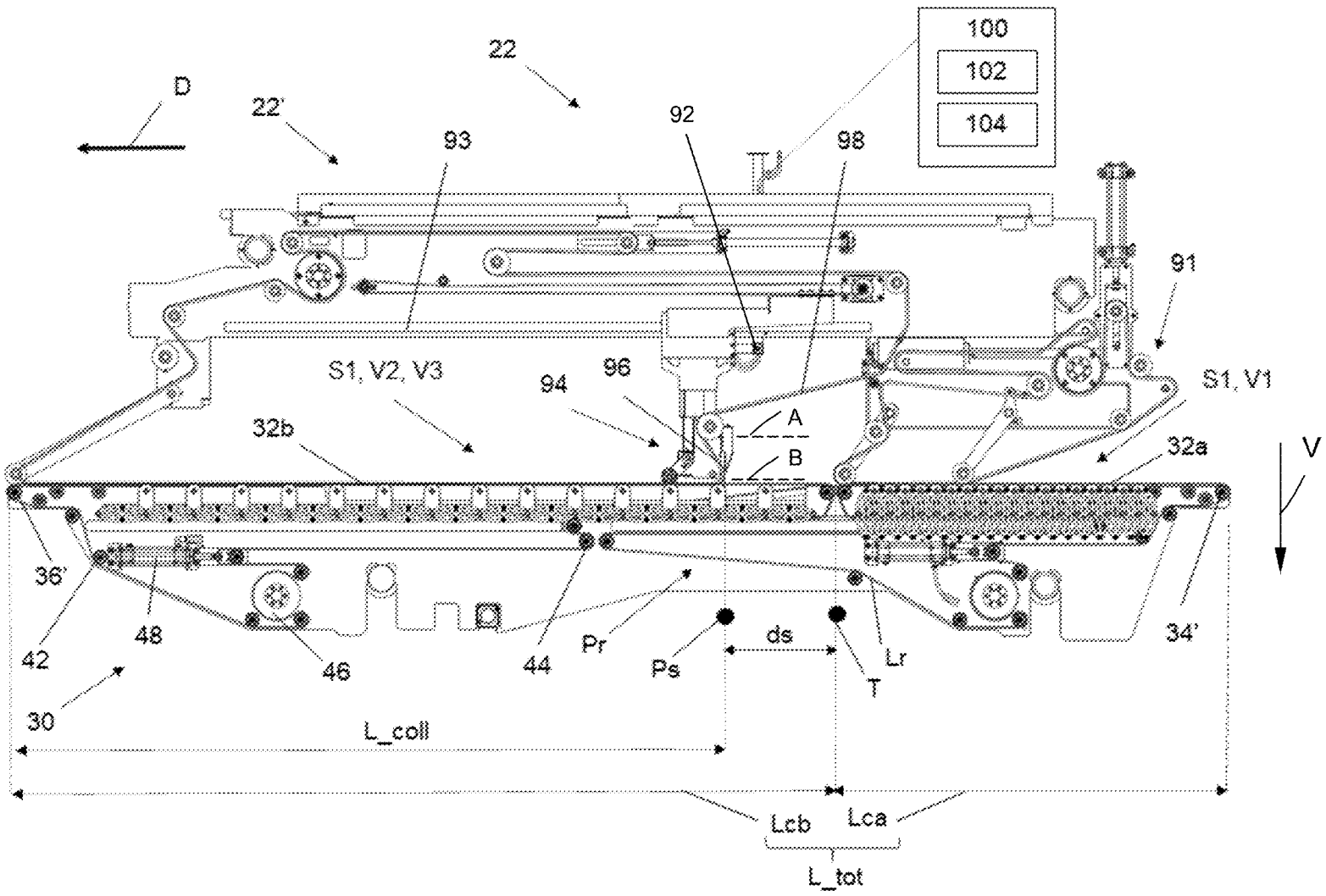
FIG. 3 is schematic longitudinal cross-sectional view of a counter-separator module according to an embodiment of the present invention.

As best seen in FIGS. 1*a*, 2 and 3, the blanks 2' are transported through the different work modules in a direction of transportation D. The transportation of the blank 2' is partially effectuated by a conveyor system 30 comprising at least one conveyor belt 32. As best seen in FIG. 2, the conveyor belt 32 is in the form of an endless belt and is contacting the blanks 2' over a contact length Lc and is provided with a return path Pr of a length Lr, over which the conveyor belt 32 is not in contact with the blanks 2'.

The inventors have found that work modules of a converting machine 1 can be provided with a conveyor system 30 with a variable contact length Lc of at least one conveyor belt 32. Such a variation in contact length Lc may have different advantageous technical effects and applications in terms of variable positions, distances, and transportation speeds.

As illustrated in FIG. 2, it can for instance be desirable to change the longitudinal position of an inlet end 34 or an outlet end 36 of a conveyor belt 32. In such a way, the longitudinal position of a transition point between two work modules can be modified. The transfer module 26 in FIG. 2 may be located upstream of a stacker module 28. The position of an outlet end 36 of the conveyor belt 32 can be set such that the rear edge 5*b* of a folding box 2 is positioned correctly in the stacker module 28. As the dimensions of the boxes 2 change between different work batches, it is advantageous to change the longitudinal position of the outlet end 36 of the conveyor belt 32.

As illustrated in FIG. 3, the present invention may also be used in order to achieve a conveyor system 30 having a fixed total length L_tot distributed over a plurality of transportation segments S1, S2 with variable longitudinal contact lengths Lca, Lcb in the direction of transportation D. Such a conveyor system 30 may have a first conveyor belt 32*a* and a second conveyor belt 32*b* arranged one after the other in the direction of transportation D. The contact lengths Lca, Lcb of each respective conveyor belt 32*a*, 32*b* can be changed, while the total contact length L_tot of the conveyor system 30 remains unchanged. This can be advantageous in applications where the first conveyor belt 32*a* and the second conveyor belt 32*b* are driven differently, such as at different speeds V1, V2.

A possible application for this configuration is a conveyor system 30 for a separator module 22, where a batch of boxes 2 is separated and spaced apart from an upstream shingled stream of boxes 2. This is preferably done by a separator head 94 which momentarily stops an upstream-located shingled stream of boxes 2 while accelerating the batch to be separated at an increased speed in the direction of transportation D.

Figure 4:
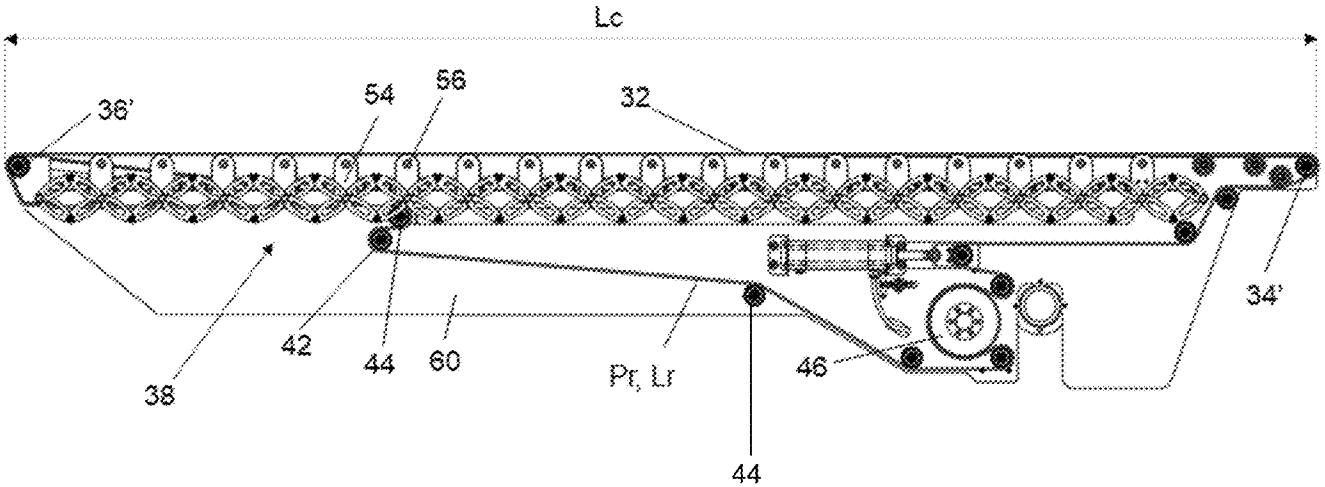
FIG. 4 is a cross-sectional view of a conveyor system according to an embodiment of the present invention.
Figure 5:
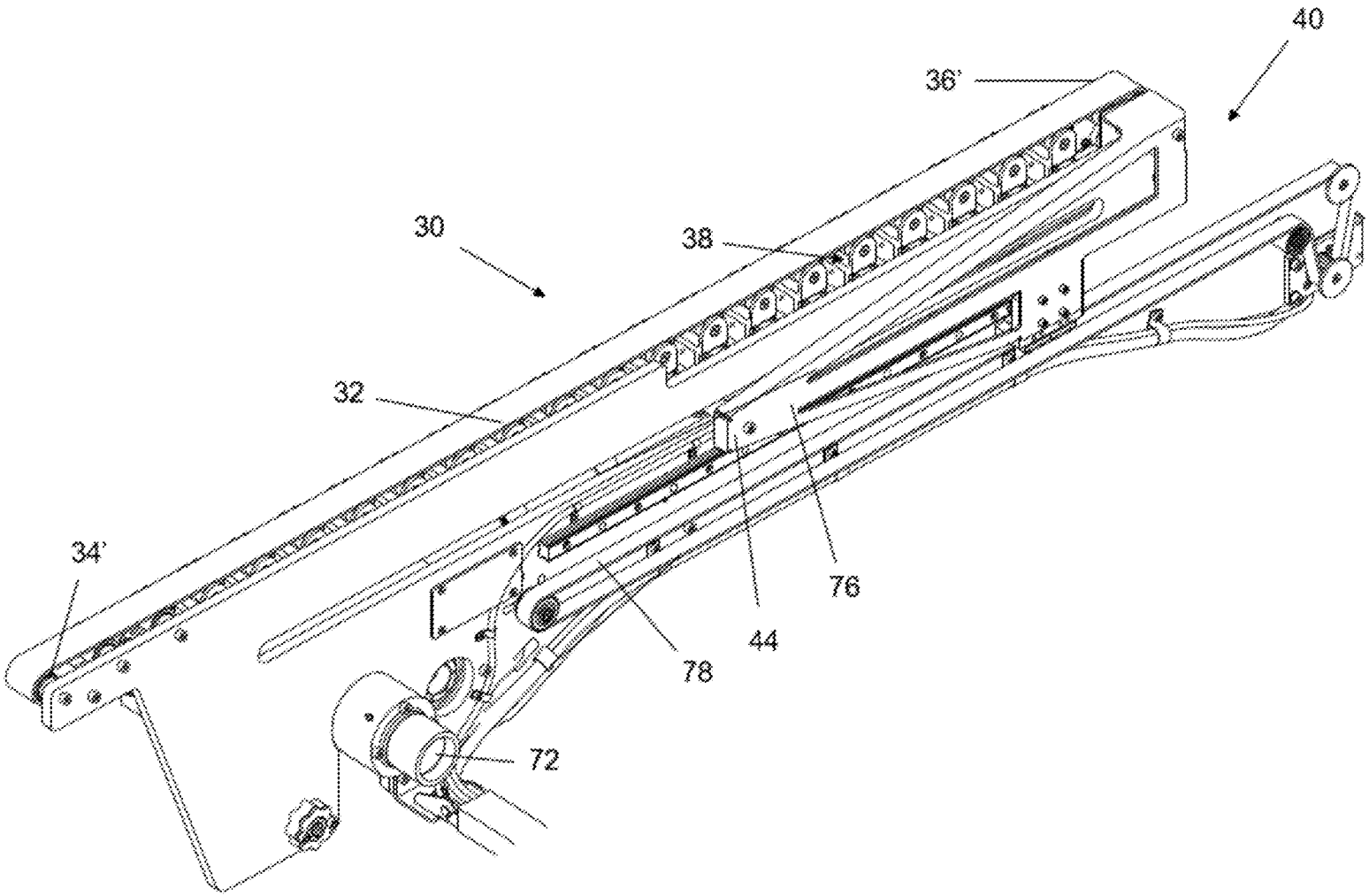
FIG. 5 is a schematic perspective view of a displacement mechanism of the conveyor system of FIG. 4.

As illustrated in FIGS. 4 and 5, the conveyor system 30 according to the present invention comprises at least one conveyor belt 32, a support structure 38 and a displacement mechanism 40. The support structure 38 is configured to support the conveyor belt 32 over at least a portion of the contact length Lc from an inlet roller 34' to an outlet roller 36'.

The trajectory of the return path Lr is supported by a plurality of guide rollers 42, a compensation roller 44 and a drive sprocket 46. The compensation roller 44 is configured to change the trajectory of the conveyor belt 32 in the return path Pr. The compensation roller 44 thus accommodates for changes in the contact length Lc by modifying the return length Lr of the conveyor belt 32 in the return path Pr.

Figure 6A:
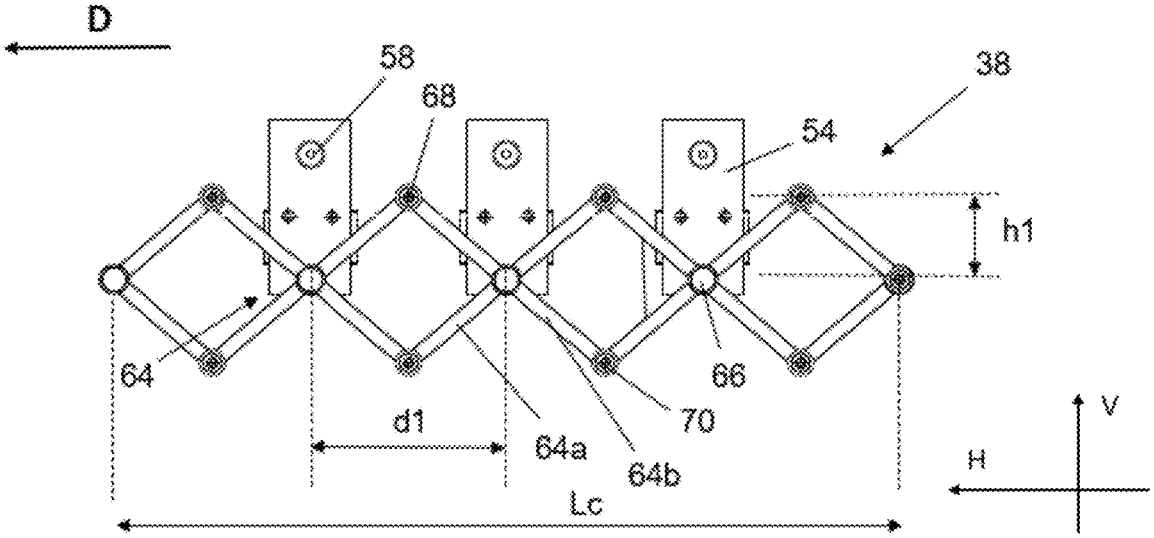
FIGS. 6*a* and 6*b* are schematic cross-sectional views of a support mechanism according to an embodiment of the present invention.
Figure 6B:
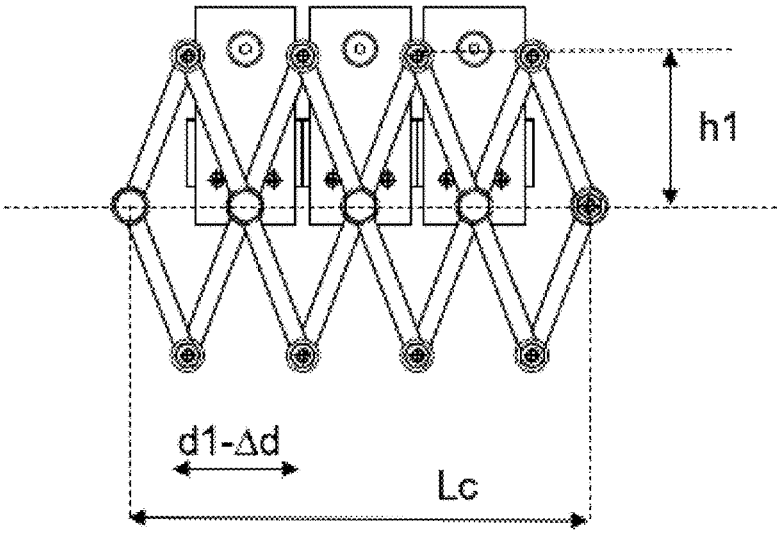
Figure 6C:
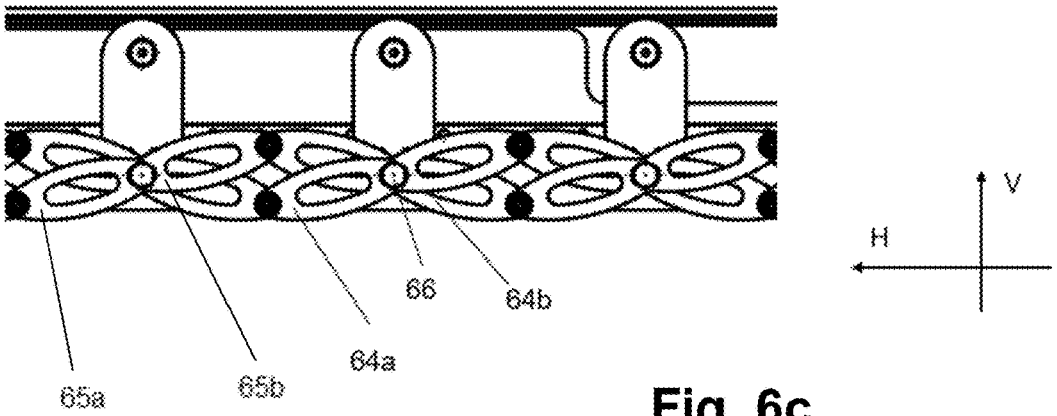
FIG. 6*c* is a schematic cross-sectional view of support mechanism according to another embodiment of the present invention.

As best seen in FIGS. 5 and 6, the compensation roller 44 can be connected to a displacement mechanism 40 configured to change the location of the compensation roller 44 such that the return length Lr is changed. As the compensation roller 44 moves, the return length Lr of the conveyor belt 32 in the return path Pr is modified.

The drive sprocket 46 is connected to a motor (not illustrated) and is configured to drive the conveyor belt 32 in motion. The conveyor belt 32 may comprise engagement means, such as a dented surface which engages with the drive sprocket 46.

Figure 7:
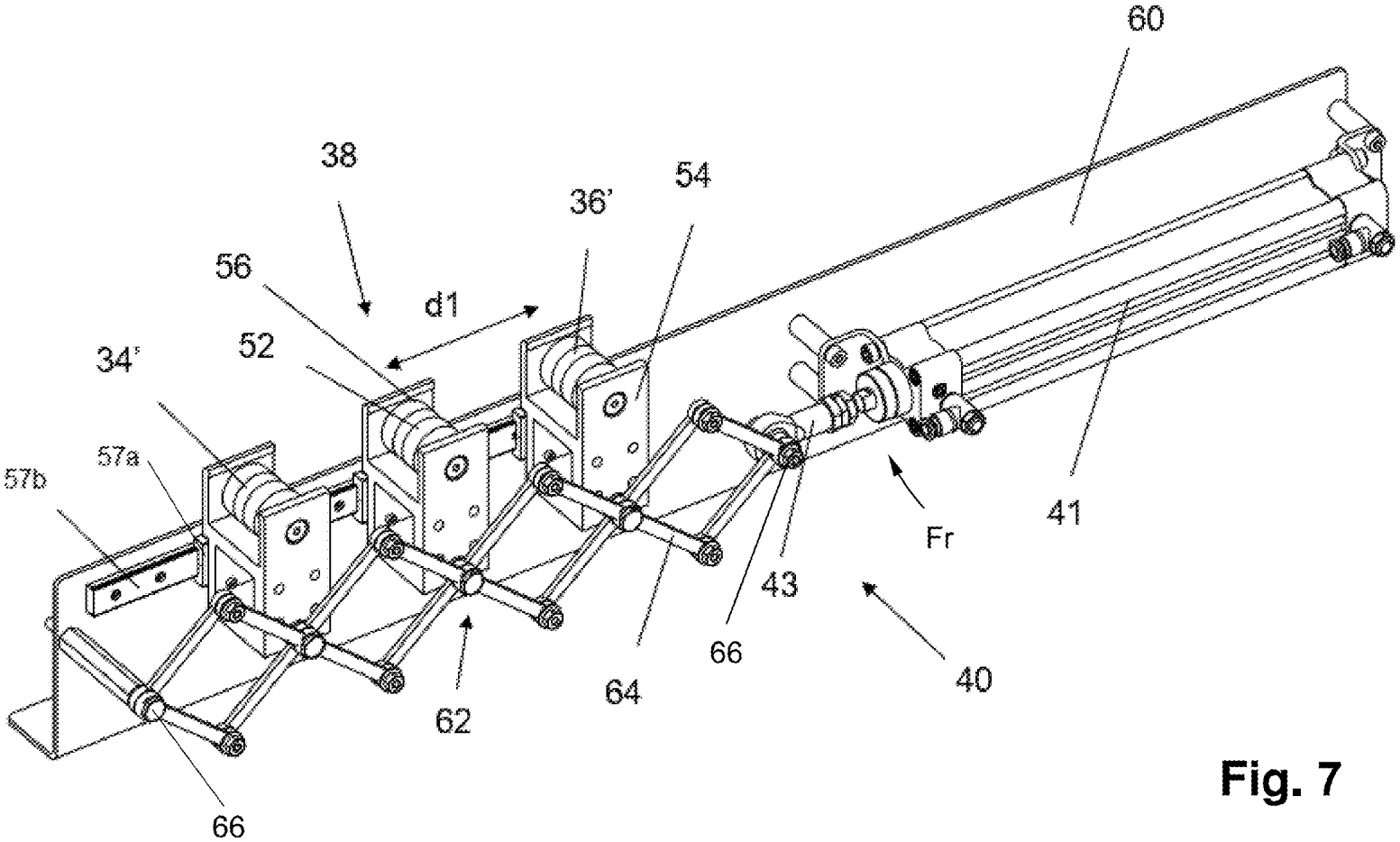
FIG. 7 is a schematic perspective view showing a connection between a support mechanism and a displacement mechanism.

As best seen in FIGS. 6*a*, 6*b* and 7, the support structure 38 comprises a plurality of support rollers 52 connected to roller frames 54 and a connection mechanism 62 located in-between the roller frames 54. Each roller frame 54 preferably further comprises a slider 57*a* connected to a guide rail 57*b*, which is connected to a longitudinal frame member 60.

The contact length Lc of the conveyor belt 32 is thus supported by support rollers 52 arranged in a line and extending in the direction of transportation D. Over the contact length Lc, a first distal roller 34' may be configured as the inlet roller 34' and a second distal roller 36' may be configured as the outlet roller 36'. Each support roller 52 is rotatably attached to a roller frame 54 by a pin 58. The support rollers 52 are preferably idle.

The conveyor system 30 may have one of the inlet roller 34' and outlet roller 36' stationary arranged, while the other roller 34', 36' is movable in the direction of transportation D. The roller frame 54 of the stationary arranged roller 34', 36' can be fixedly connected to the longitudinal frame member 60 of the work module. Alternatively, and as illustrated in FIGS. 4 and 5, a distal central pivot 66 of the connection mechanism 62 is stationary while the outlet roller 36' is displaceable in the direction of transportation D.

The sliders 57*a* of the roller frames 54 are slidably mounted onto the guide rail 57*b*. The guide rail 57*b* is fixedly mounted to the longitudinal frame member 60. The guide rail 57*b* restricts the movement of the roller frames 54 to the direction of transportation D.

The roller frames 54 are connected to each other in a line by the connection mechanism 62. The connection mechanism 62 is extendable and retractable in the direction of conveyance D such that a distance d1 between the support rollers 52 can be changed.

The connection mechanism 62 comprises a plurality of pivotable connection links 64. A pivotable connection link 64 is arranged between each of the roller frames 54. The connection mechanism 62 is configured such that a change in contact length ΔLc of the conveyor belt 32 is distributed over the plurality of pivotable connection links 64 in an equidistant displacement. The pivotable connection links 64 are thus configured to impart an equidistant displacement Δd between the roller frames 54. This means that when one of the roller frames 54 is displaced at a distance Δd, the remaining roller frames 54 are displaced at the same distance Δd.

The equidistant displacement may be calculated as:

$$\Delta d = \Delta Lc / N$$

where:

Δd: displacement distance between rollers

ΔLc: change in contact length of conveyor belt

N: number of pivotable connection links

In order to restrict the displacement to be equidistant and to maintain an equal distance d1 between the rollers 56, the pivotable connection link 64 comprises a central pivot 66 connected to each roller frame 54, an upper pivot 68 and a lower pivot 70. The pivotable connection links 64 can be provided by two linear elements 64*a*, 64*b*.

In a preferred embodiment, the pivotable connection link 64 is symmetrical about a horizontal axis H extending through the central pivot 66. The horizontal axis H is coinciding with the longitudinal extension L of the support structure 38.

In this configuration, the pivotable connection links 64 form a plurality of "X-shapes" where the central pivot 66 is connected to each roller frame 54. By connecting the roller frames 54 to the central pivot 66, the horizontal position of the central pivot 66 is kept constant. However, a distance h1 between the central pivot 66 and the upper pivot is variable. As best seen in FIGS. 6*a* and 6*b*, the upper pivots 68 and the lower pivots 70 move in the vertical direction V when the support structure 38 is extended or retracted in the direction of transportation D. The X-shape also ensures that a resulting force Fr from the actuator 41 is linear in the connection to the roller frames 54.

The pivotable connection links 64 can be provided by two linear elements 64*a*, 64*b*, each provided with a first convex shape 65*a* and a second convex shape 65*b*. The convex shape allows the strain to be better distributed in the connection links 64. Alternatively, as illustrated in FIG. 7, the pivotable connection links 64 may be linear elements with a uniform width and thickness.

As illustrated in FIG. 7, the displacement mechanism 40 is connected to the connection mechanism 62. The displacement mechanism 40 may comprise a piston actuator 41 which can be directly connected to a movable roller frame 54 of the movable roller 34' via an actuator rod 43. Alternatively, the piston actuator 41 can be connected to the movable roller frame 54 via a central pivot 66. The movable roller 34' can be moved in the direction of transportation D in response to a change in the stroke length of the actuator rod 43.

In another embodiment, and as illustrated in FIG. 5, the displacement mechanism 40 may comprise a drive mechanism 72 and a connection frame 76. The connection frame 76 is connected to the movable distal roller 36' via its roller frame 54. The drive mechanism 72 is configured to displace the connection frame 76 in the direction of transportation D. The drive mechanism 72 may comprise a displacement conveyor 78 attached to the connection frame 76 and a motor configured to move the displacement conveyor 78. Alternatively, the drive mechanism 72 may comprise a piston.

The connection frame 76 may also be connected to a compensation roller 44 and configured to provide an equal displacement of the movable distal roller 36' and the compensation roller 44. In such a way, the absolute amount of displacement in the contact length Lc and the return length Lr is equal. If the contact length Lc increases with a length ΔLc, the return length Lr decreases with a length ΔLc, and vice versa.

Referring to back to FIG. 3, in which the conveyor system 30 has a first conveyor belt 32*a* and a second conveyor belt 32*b* arranged one after the other in the direction of transportation D. In this embodiment, each conveyor belt 32*a*, 32*b* is contacting a separate support structure 38.

As illustrated in FIGS. 8*a*, 8*b*, 10 and 11, a displacement mechanism 40 for such a conveyor system 30 may comprise an elongated frame member 76 connected to the outlet roller 36' of the first conveyor belt 32*a* and the adjacent inlet roller 34' of the second conveyor belt 32*b*. The elongated frame member 76 is movable in a reciprocating manner in the direction of transportation D. The direction of transportation D is coinciding with the longitudinal extension of the first conveyor belt 32*a* and second conveyor belt 32*b*. The adjacent rollers 34', 36' are thus fixedly mounted to the elongated frame member 76. This ensures that the distance Dp between the rollers 34', 36' in the transition point T between the rollers 34', 36' is unchanged. Moreover, this also results in that an increase in the contact length ΔLc of one conveyor belt 32*a*, 32*b* imparts a similar reduction of contact length ΔLc to the other conveyor belt 32*a*, 32*b*.

Figure 9A:
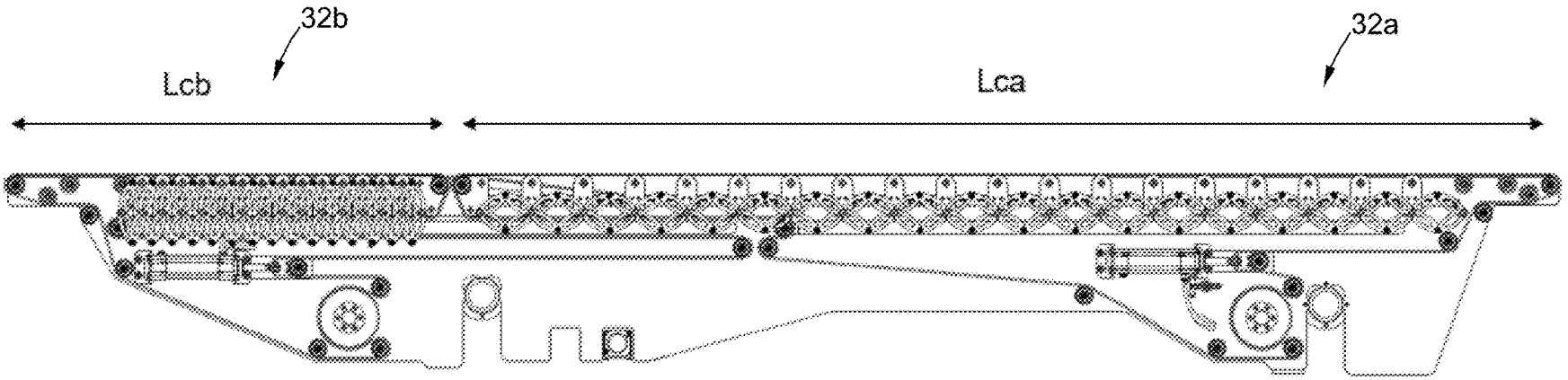
FIGS. 9*a* and 9*b* are cross-sectional views of the conveyor system which illustrate its maximum extension and retraction.
Figure 9B:
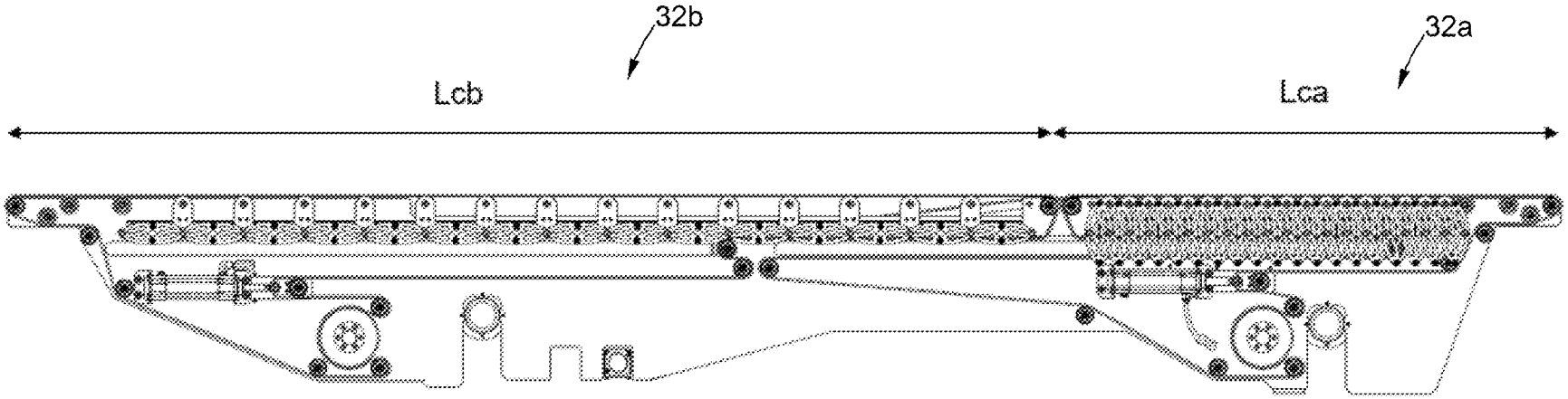

This is further illustrated in FIGS. 9*a* and 9*b*, where FIG. 9*a* shows a configuration where the contact length Lca of the first conveyor belt 32*a* is in its most extended position. FIG. 9*b* shows the configuration where the contact length Lcb of the second conveyor belt 32*b* is in its most extended position.

Figure 10:
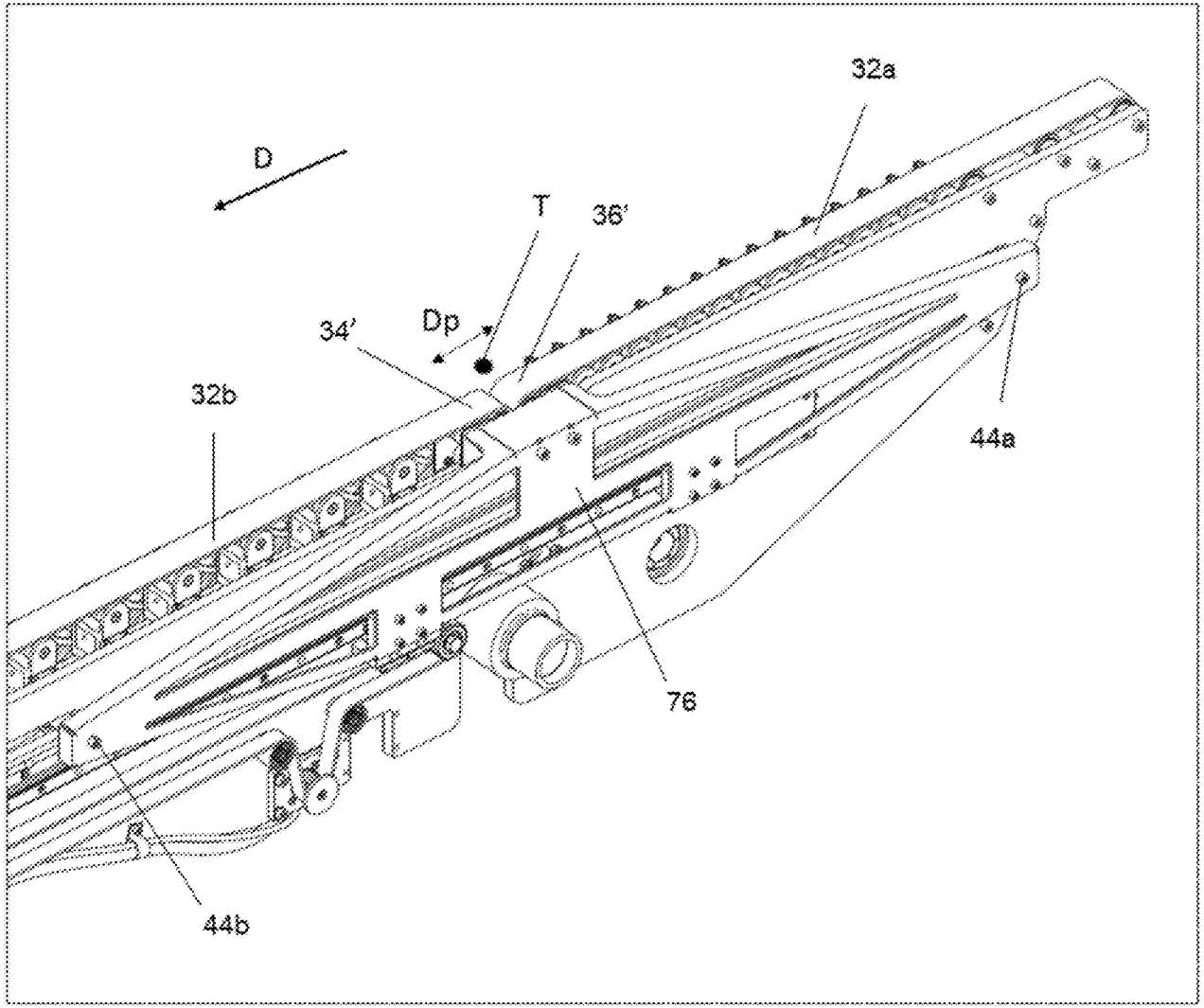
FIG. 10 is a detailed schematic perspective view of a displacement mechanism.

Preferably, and as best seen in FIG. 10, the frame member 76 is also connected to a first compensation roller 44*a* of the first conveyor belt 32*a* and to a second compensation roller 44*b* of the second conveyor belt 32*a*. In such a way, an equal displacement of the movable end rollers 34', 36' and the compensations rollers 44*a*, 44*b* is provided in response to a displacement of the elongated frame member 76 in the direction of transportation D.

Figure 11:
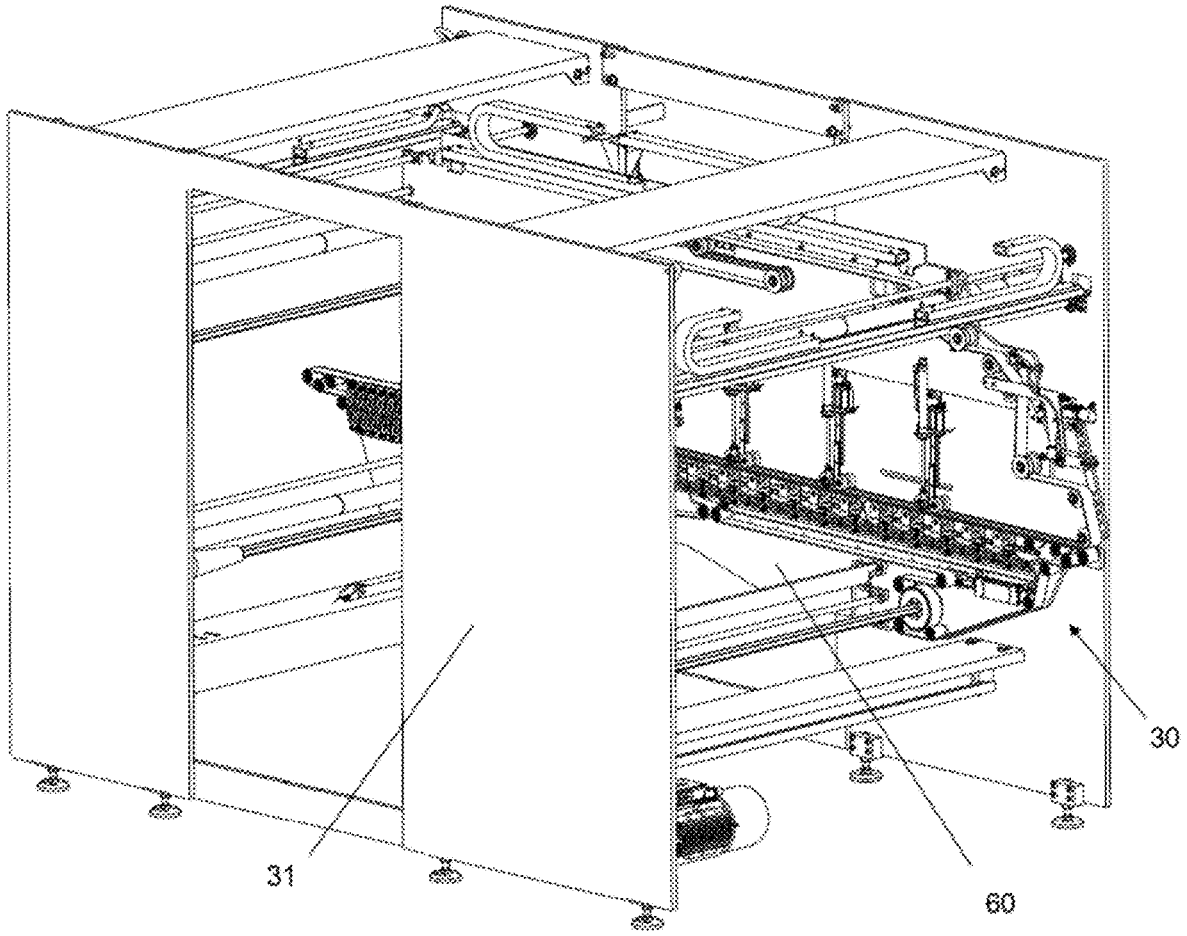
FIG. 11 is a schematic perspective view of a conveyor system mounted onto a frame of a work module.

As illustrated in FIG. 11, the conveyor system 30 can be mounted onto a frame 31 of a work module. The work module may comprise several conveyor systems 30 mounted in parallel in the direction of transportation D.

Figure 8A:
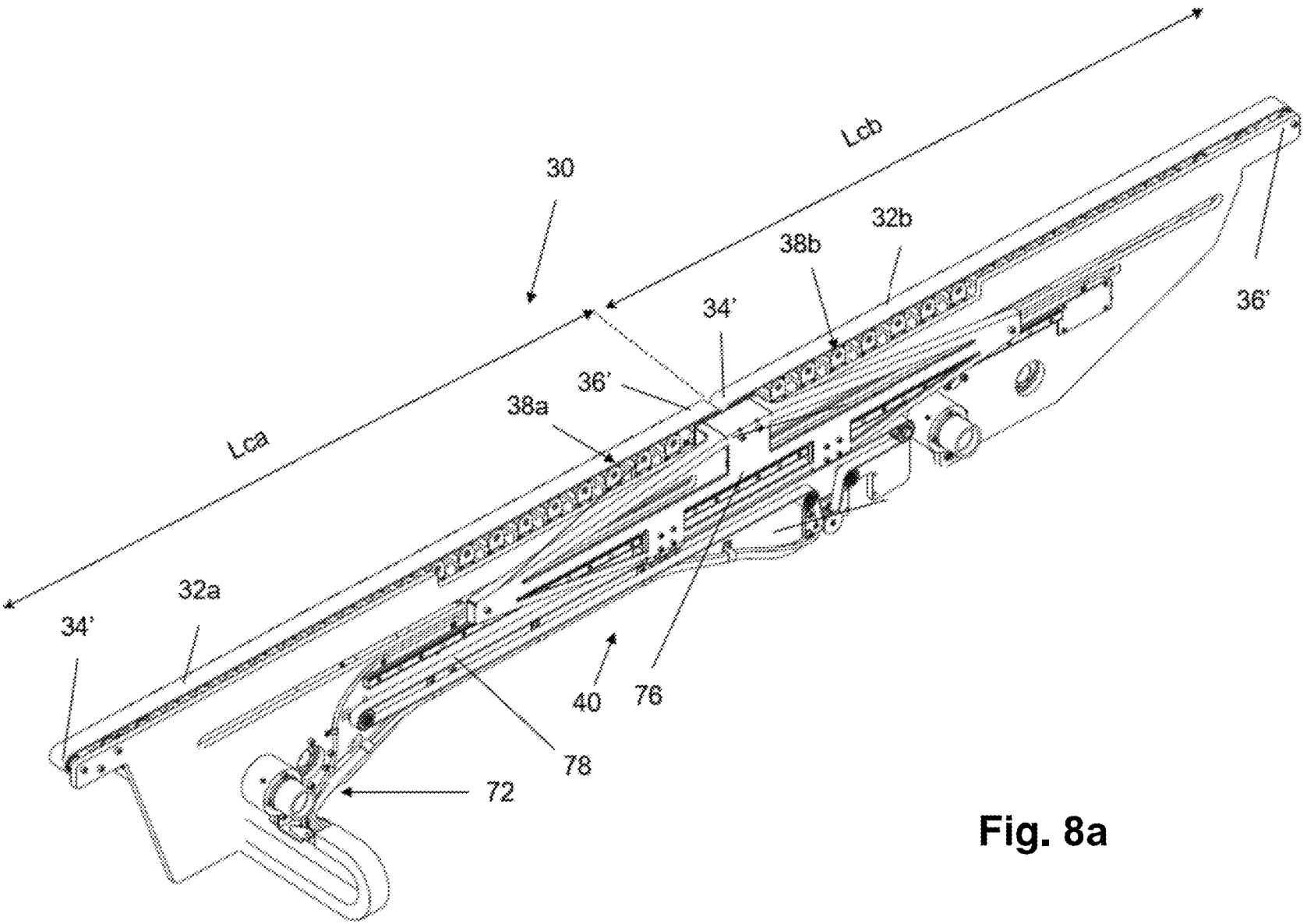
FIGS. 8*a* and 8*b* are schematic perspective views of a conveyor system provided with two conveyor belts according to another embodiment of the present invention.
Figure 8B:
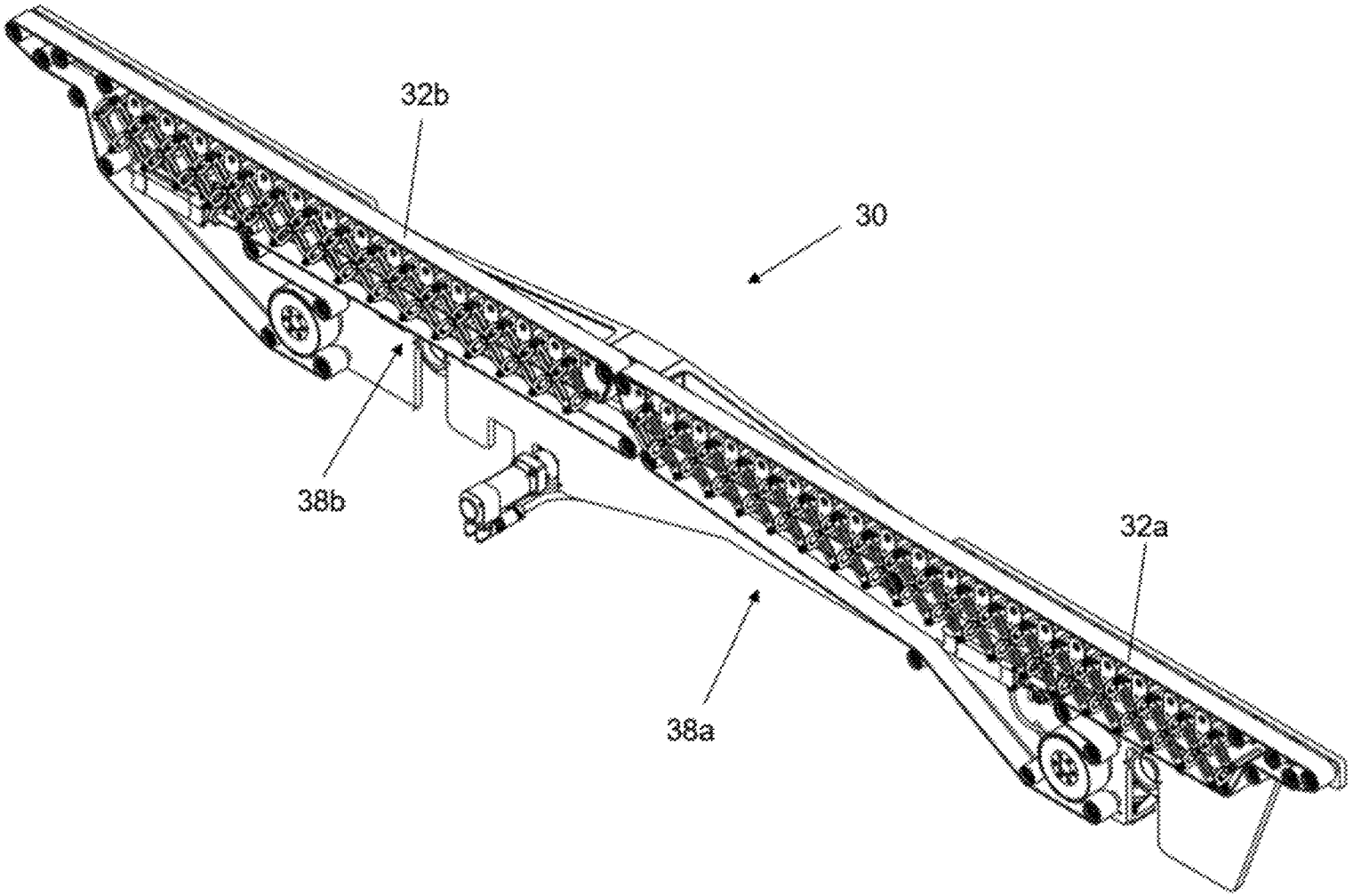

The conveyor system 30 illustrated in FIGS. 3, 8*b*, 8*b* and 11 is suitable for a separator module 22. The separator module 22 is configured to separate a shingled stream of boxes 2 into separate batches and further convey them to a banding module 29, which applies retaining bands to assemble the boxes 2 in bundles.

As best seen in FIG. 3, the separator module 22 comprises an inlet section 91, and a separator device 22'. The separator device 22' comprises a vertically movable separator head 94, and a lower conveyor system 30. The separator module 22 may also further comprise a counting device 92, configured to count the boxes 2.

The separator head 94 is configured to move up and down in the vertical direction V between a counting position A and a separating position B. A batch is separated from an upstream shingled stream of boxes 2 when the separator head 94 descends from the counting position A into the separating position B.

The separator head 94 is provided with a thrust plate 96 (also referred to as "stop plate") and an evacuation conveyor 98. The evacuation conveyor 98 comprises at least one evacuation conveyor belt 99. Preferably, the evacuation conveyor 98 comprises two parallel evacuation conveyor belts 99. This allows the evacuation conveyor 98 to transport the boxes 2 while preventing rotation of the boxes 2.

The thrust plate 96 is configured to abut against the front leading edges 5*a* of the upstream shingled stream of boxes 2 such that they are momentarily stopped. A longitudinal separation point Ps can be defined by the position of the thrust plate 96. While the upstream-located boxes 2 are stopped, the evacuation conveyor belts 99 are moved at a speed V3. Preferably, the speed of the evacuation belts 99 changes from zero to V3.

The counting device 92 is configured to count the number of boxes 2 passing by the counting device 92. The counting device 92 may comprise a photoelectric cell, which optically detects the front leading edge 5*a* of the boxes 2. Alternatively, a mechanical counting device 92 may be used. For instance, a counting wheel can be in contact with the shingled stream of boxes 2 and can be configured to count in response to a registered up and down movement of the counting wheel.

When a desired number of boxes 2 has passed the counting device 92, the separator head 94 is moved downwardly into the separating position B to stop the remaining shingled stream of boxes 2. The separated batch can then be further conveyed to towards the banding module 29.

To further space the separated batch apart from the upstream shingled stream of boxes 2, the transportation speed of the separated batch may advantageously be increased downstream of the separation point Ps. In order to provide an increased transportation speed, the batch of boxes is accelerated after the location of the thrust plate 96.

In order to provide a speed difference, the lower conveyor system 30 is provided with a first conveyor belt 32*a* and a second conveyor belt 32*b* as illustrated in FIGS. 3, 8*a*, 8*b*, 9*a* and 9*b* and as previously described. The first conveyor belt 32*a* can be referred to as an inlet conveyor belt 32*a* and the second conveyor belt 32*b* can be referred to as a lower evacuation conveyor belt 32*b*.

The first conveyor belt 32*a* is driven at a speed V1. The first speed V1 may be the same speed as an upstream-located module.

The second conveyor belt 32*b* is configured to be accelerated between a second speed V2 and a third speed V3. The second speed V2 may be equal to the first speed V1 of the first conveyor belt 32*a*. The third speed V3 is higher than the first speed V1. The third speed V3 is also higher than the second speed V2.

The descent of thrust plate 96 is preferably located over the second conveyor belt 32*b*. Alternatively, the thrust plate 96 can be located in the transition point T between the first conveyor belt 32*a* and the second conveyor belt 32*b*.

When the separator head 94 is in the counting position A, the second conveyor belt 32*b* of the lower conveyor may be driven at the same speed V1 as the first conveyor belt 32*a* of the lower conveyor system 30.

The upper evacuation conveyor belts 99 and the lower evacuation conveyor belt 32*b* are moved at the same speed V3 when the separator head is in the evacuation position B. Both the upper evacuation conveyor belts 99 and the lower evacuation conveyor belt 32*b* are accelerated once the separator head 94 reaches the evacuation position B.

The conveyor system 30 may be further connected to a control system 100 comprising a control unit 102 and a memory 104. The control system 100 is configured to determine the longitudinal position (in the direction of transportation D) of the separator head 94 in relation to the number of boxes 2 to be included in each bundle and the format of the boxes 2. The longer the boxes 2 are in the direction of transportation D and/or the more boxes 2 to be included in each bundle, the longer accumulation distance L_coll (see FIG. 3) on the second conveyor belt 32*b* is needed.

The control system 100 may be configured to determine a theoretical longitudinal separation point Ps of the separator head 94 based on box dimensions entered into the control system 100. However, there may be some variations in the conveyance of the boxes 2. Therefore, the separator head 94 may be further configured to adapt its longitudinal position in response to information from the counting device 92.

The counting device 92 indicates the number of boxes 2 that has passed downstream of the separation point Ps. At the passage of the last box 2 in a predefined number of the bundle, the counting device may also provide a time of passage of the front edge 5*a* of the last box 2 which indicates a register position to the separator head 94. In such a way, the separator head 94 can descend with precision and keep a constant and predetermined number of boxes 2 in each bundle.

The transition point T between the first conveyor belt 32*a* and the second conveyor belt 32*b* can be determined from the position of the separator head 94. For instance, the transition point T may be located at a predetermined distance ds from the separator head. The transition point T between the first and the second conveyor belts 32*a*, 32*b* may dynamically follow the longitudinal position of the separator head 94 for each batch of boxes 2.

A first mechanism enabling such an adjustment is a top frame portion 95 of the counter-separator module to which the separator head 94 is movably mounted. The top frame portion 95 may comprise a slide rail 93 (see FIG. 3) to which the separator head is slidably mounted. In such a way, the separator head 94 can be moved and positioned in a desired location in the direction of transportation D.

The boxes 2 are pinched in between the upper evacuation conveyor belts 99 and the lower evacuation conveyor 32*b*. This provides an improved stability of the shingled stream of boxes 2 and smaller formats of boxes can be handled with increased stability as they are supported on both the top and the bottom sides.

The conveyor system 30 may comprise a first lower conveyor system 30*a* and a second lower conveyor system 30*b* arranged parallel in relation to each other. Hence, both conveyor systems comprise a first conveyor belt 32*a* and the second conveyor belt 32*b*. In this embodiment, the upper evacuation conveyor also preferably comprises a first and a second evacuation conveyor belt 99. In such a way, the boxes 2 are pinched between four conveyor belts.

The invention claimed is:

1. A conveyor system for transporting blanks in a converting machine, the conveyor system comprising an endless first conveyor belt and a support structure, wherein the first conveyor belt is configured to convey the blanks along a direction of transportation, the first conveyor belt having a contact length supported by the support structure and a return length, the support structure comprising a plurality of rollers, each roller being attached to a roller frame and arranged in a line, the roller frames being connected to each other by a connection mechanism, wherein a plurality of the roller frames is movable in the direction of transportation, wherein a displacement mechanism connected to the connection mechanism comprises a connection frame connected to a distal movable roller frame, wherein the connection mechanism is extendable and retractable in the direction of transportation, such that the contact length of the first conveyor belt is modified and all rollers remain in contact with the first conveyor belt, wherein the connection mechanism comprises a plurality of pivotable links, and wherein the connection frame is connected to a movable compensation roller to provide an equal displacement of the movable roller frame and the compensation roller.

2. The conveyor system according to claim 1, wherein at least one distal roller frame of the plurality of the roller frames is stationary.

3. The conveyor system according to claim 1, wherein a plurality of roller frames is slidably mounted to a linear guide rail.

4. The conveyor system according to claim 1, wherein each roller is mounted on a separate roller frame.

5. The conveyor system according to claim 1, wherein the connection mechanism is configured to impart an equidistant displacement distance between the movable roller frames.

6. The conveyor system according to claim 1, wherein the pivotable connection links comprise a first linear connection element and a second linear connection element, and wherein the linear connection elements form a cross, the first and second linear connection elements having their central pivot point and connection to each roller frame in the center of the cross.

7. The conveyor according to claim 6, wherein the linear connection elements are further connected in an upper pivot point and a lower pivot point, and wherein the upper and lower pivot points are horizontally immobile but vertically mobile in response to a displacement distance from the displacement mechanism, and wherein the central pivot point is horizontally movable in the direction of transportation but vertically immobile.

8. The conveyor according to claim 6, wherein the first and second linear connection elements each have a first convex shape and a second convex shape, and wherein the central pivot point is located between the first and second convex shapes.

9. The conveyor according to claim 8, wherein the first and second convex shapes are hollow in the center.

10. The conveyor system according to claim 1, wherein the conveyor system further comprises a second conveyor belt arranged after the first conveyor belt in the direction of transportation, and wherein the second conveyor belt is supported by a second support structure, and wherein the displacement mechanism is configured to increase the contact length of one conveyor belt, while reducing the contact length of the other conveyor belt with the same amount.

11. The conveyor system according to claim 10, wherein the connection frame is connected to the distal movable rollers of the support structures of the first conveyor belt and the second conveyor belt, respectively, and wherein the connection frame is configured to perform a reciprocating movement in the direction of transportation.

12. The conveyor system according to claim 11, wherein the connection frame is further attached to a compensation roller of the first conveyor belt and a compensation roller of the second conveyor belt whereby a displacement of the connection frame both modifies the contact lengths and the return lengths of the first and second conveyor belts.

13. The conveyor system according to claim 11, wherein the displacement mechanism comprises a motor and a displacement conveyor and wherein the displacement conveyor is attached to the connection frame.

14. The conveyor system according to claim 11, wherein the displacement mechanism comprises a linearly movable piston actuator connected to the connection frame.

* * * * *